US009797632B2

(12) United States Patent
Parish et al.

(10) Patent No.: US 9,797,632 B2
(45) Date of Patent: Oct. 24, 2017

(54) DUAL CORE PERSONAL COMFORT ENGINE (PCE)

(71) Applicant: Marlow Industries, Inc., Dallas, TX (US)

(72) Inventors: Overton (Bud) Parish, Frisco, TX (US); Leonard Recine, Plano, TX (US)

(73) Assignee: MARLOW INDUSTRIES, INC., Dallas, TX (US)

( * ) Notice: Subject to any disclaimer, the term of this patent is extended or adjusted under 35 U.S.C. 154(b) by 289 days.

(21) Appl. No.: 14/637,149

(22) Filed: Mar. 3, 2015

(65) Prior Publication Data

US 2015/0247656 A1 Sep. 3, 2015

Related U.S. Application Data

(60) Provisional application No. 61/947,306, filed on Mar. 3, 2014.

(51) Int. Cl.

| | |
|---|---|
| ***F25B 21/02*** | (2006.01) |
| ***A47C 21/04*** | (2006.01) |
| ***A47G 9/02*** | (2006.01) |

(52) U.S. Cl.

CPC ..... *F25B 21/02* (2013.01); *A47C 21/044* (2013.01); *A47C 21/048* (2013.01); *A47G 9/0215* (2013.01); *F25B 2321/0251* (2013.01)

(58) Field of Classification Search

CPC .. A47C 21/048; A47C 21/044; A47G 9/0215; F25B 2321/0251

USPC ..... 62/3.5, 3.61

See application file for complete search history.

(56) References Cited

U.S. PATENT DOCUMENTS

| | | | | |
|---|---|---|---|---|
| 4,634,803 | A * | 1/1987 | Mathiprakasam | H01L 35/28 136/201 |
| 5,092,129 | A * | 3/1992 | Bayes | B64G 6/00 62/259.3 |
| 5,456,081 | A * | 10/1995 | Chrysler | H01L 23/38 136/204 |
| 5,655,375 | A * | 8/1997 | Ju | F25B 21/04 361/695 |
| 6,705,089 | B2 * | 3/2004 | Chu | F25B 21/02 136/204 |
| 6,755,026 | B2 * | 6/2004 | Wallach | A61M 1/369 607/106 |

(Continued)

OTHER PUBLICATIONS

Notification of Transmittal of the International Search Report and the Written Opinion of the International Searching Authority, or the Declaration dated Jun. 16, 2015 in connection with International Patent Application No. PCT/US15/18514.

*Primary Examiner* — Emmanuel Duke

(57) ABSTRACT

In accordance with one embodiment, there is provided a thermoelectric-based air conditioning system. The system includes at least a first supply air channel and a separate second supply air channel disposed in a housing. The system also includes a first thermoelectric cooler (TEC) assembly forming at least a portion of the first supply air channel and configured to independently condition air within the first supply air channel. The system further includes a second TEC assembly forming at least a portion of the second supply air channel and configured to independently condition air within the second supply air channel. The system includes a single heat exchanger configured to transfer heat with both the first TEC assembly and the second TEC assembly.

20 Claims, 13 Drawing Sheets

(56) References Cited

U.S. PATENT DOCUMENTS

| | | | | |
|---|---|---|---|---|
| 2002/0124574 | A1 | 9/2002 | Guttman et al. | |
| 2003/0140636 | A1* | 7/2003 | Van Winkle | F01P 9/06 62/3.61 |
| 2005/0121065 | A1* | 6/2005 | Otey | H01L 35/30 136/205 |
| 2007/0112401 | A1* | 5/2007 | Balachandran | A61F 7/02 607/104 |
| 2007/0145572 | A1* | 6/2007 | Chen | F28D 15/0266 257/718 |
| 2009/0000310 | A1* | 1/2009 | Bell | B60H 1/00271 62/3.7 |
| 2009/0126772 | A1* | 5/2009 | Machida | F25B 21/02 136/222 |
| 2009/0199571 | A1 | 8/2009 | Creech et al. | |
| 2011/0289684 | A1* | 12/2011 | Parish | A47C 21/044 5/421 |
| 2012/0222429 | A1* | 9/2012 | Ban | B60H 1/00478 62/3.61 |

* cited by examiner

TEST CONDITIONS:

| | | | |
|---|---|---|---|
| TEST GAS | WATER VAPOR | TEST TEMPERATURE | 37.8 (°C) 100.0 (°F) |
| TEST GAS CONCENTRATION | N/A | CARRIER GAS | NITROGEN |
| TEST GAS HUMIDITY | 100% RH | CARRIER GAS HUMIDITY | 0% RH |

TEST RESULTS:

| SAMPLE IDENTIFICATION | MOCON ID# | WATER VAPOR TRANSMISSION RATE g/(PACKAGE-DAY) |
|---|---|---|
| CORE REV 2, Ultem | 6751.001 | 0.00145 |
| CORE REV 2, Ultem | 6751.001 | 0.00188 |
| CORE REV 2, Ultem | 6751.001 | 0.00134 |
| PCE-302 PRODUCTION | 6751.002 | 0.0816 |
| PCE-302 PRODUCTION | 6751.002 | 0.0783 |
| PCE-302 PRODUCTION | 6751.002 | * > 0.5 |

NOTE: ABOVE SAMPLES WERE ANALYZED ON A MOCON PERMATRAN-W 3/33 WATER VAPOR PERMEABILITY INSTRUMENT

FIG. 9

DUAL CORE PERSONAL COMFORT ENGINE (PCE)

CROSS-REFERENCE TO RELATED APPLICATIONS AND CLAIM FOR PRIORITY

The present application claims priority to U.S. provisional patent application Ser. No. 61/947,306 filed on Mar. 3, 2014, which is incorporated herein by reference.

TECHNICAL FIELD

The present application relates generally to a user controlled personal comfort system and, more particularly, to an improved dual core thermoelectric engine (TE) and TE cooler.

BACKGROUND

Current TE systems are designed to operate either in cooling, heating, or a switchable mode of both, and provide for only a single output of conditioned air (or other fluid). When multiple thermoelectric coolers (TECs) are mounted to a common exchanger, all of the TECs are operated together, and all operated with the same thermal polarity to provide a single output of conditioned air. In practical applications then, the TE system (with multiple TECs) can only be used to generate flow(s) of either cooled air or heated air.

SUMMARY

In accordance with one embodiment, there is provided a thermoelectric-based air conditioning system. The system includes at least a first supply air channel and a separate second supply air channel disposed in a housing. The system also includes a first thermoelectric cooler (TEC) assembly forming at least a portion of the first supply air channel and configured to independently condition air within the first supply air channel. The system further includes a second TEC assembly forming at least a portion of the second supply air channel and configured to independently condition air within the second supply air channel. The system includes a single heat exchanger configured to transfer heat with both the first TEC assembly and the second TEC assembly.

In accordance with another embodiment, there is provided a thermoelectric cooler (TEC) system. The system includes at least a first TEC assembly and a second TEC assembly. The system also includes a single heat exchanger configured to transfer heat with both the first TEC assembly and the second TEC assembly.

In accordance with yet another embodiment, there is provided a thermoelectric cooler (TEC) system. The system includes at least a first TEC assembly and a second TEC assembly. The system also includes a single heat exchanger configured to transfer heat with both the first TEC assembly and the second TEC assembly One or more fluid conduits extend through at least a portion of the single heat exchanger.

Before undertaking the DETAILED DESCRIPTION OF THE INVENTION below, it may be advantageous to set forth definitions of certain words and phrases used throughout this patent document. The term "packet" refers to any information-bearing communication signal, regardless of the format used for a particular communication signal. The terms "application," "program," and "routine" refer to one or more computer programs, sets of instructions, procedures, functions, objects, classes, instances, or related data adapted for implementation in a suitable computer language. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 9 illustrates test conditions and test results of an embodiment of a thermal heat transfer device assembly according to the present disclosure.

DETAILED DESCRIPTION

FIGS. 1 through 10D, discussed below, and the various embodiments used to describe the principles of the one aspect of the present disclosure in this patent document are by way of illustration only and should not be construed in any way to limit the scope of the disclosure. Those skilled in the art will understand that the principles of the present disclosure may be implemented in any suitably arranged personal cooling (including heating) system. As will be appreciated, though the term "cooling" is used throughout, this term also encompasses "heating" unless the use of the term cooling is expressly and specifically described to only mean cooling. In addition, as will be appreciated, the devices, methods and systems shown and described herein may be incorporated or utilized in many different application, including within various personal comfort systems and thermal modules.

The personal air conditioning control system and the significant features are discussed in the preferred embodiments. With regard to the present disclosure, the term "distribution" refers to the conveyance of thermal energy via a defined path by conduction, natural or forced convection. The personal air conditioning control system can provide or generate conditioned air flow (hereinafter referred to as "air flow" or "air stream" or "air flow path"). The air flow may be conditioned to a predetermined temperature or proportional input power control, such as an air flow dispersed at a lower or higher than ambient temperature, and/or at a controlled humidity. In addition, heat sinks/sources (exchangers) that are attached, or otherwise coupled, to a thermoelectric engine/heat pump core/thermoelectric cooler surface that provide conditioned air stream(s) to the distribution layer will be referred to as "supply sink/source". Heat sinks/sources that are attached, or otherwise coupled, to a TEC surface that is absorbing the waste energy will be referred to as "exhaust sink/source". In other words, the terms "sink" and "source" can be used interchangeably herein. Passive cooling refers to ambient air (forced) only cooling systems without inclusion of an active heating/cooling device.

When referring to a dual core TE system, each of the two (or more) sets of TECs will have a common side exchanger (also referred to as the hot side exchanger) and each will have separate individual exchangers (also referred to as the cold side exchangers) referred to heat exchanger.

Figure 1:
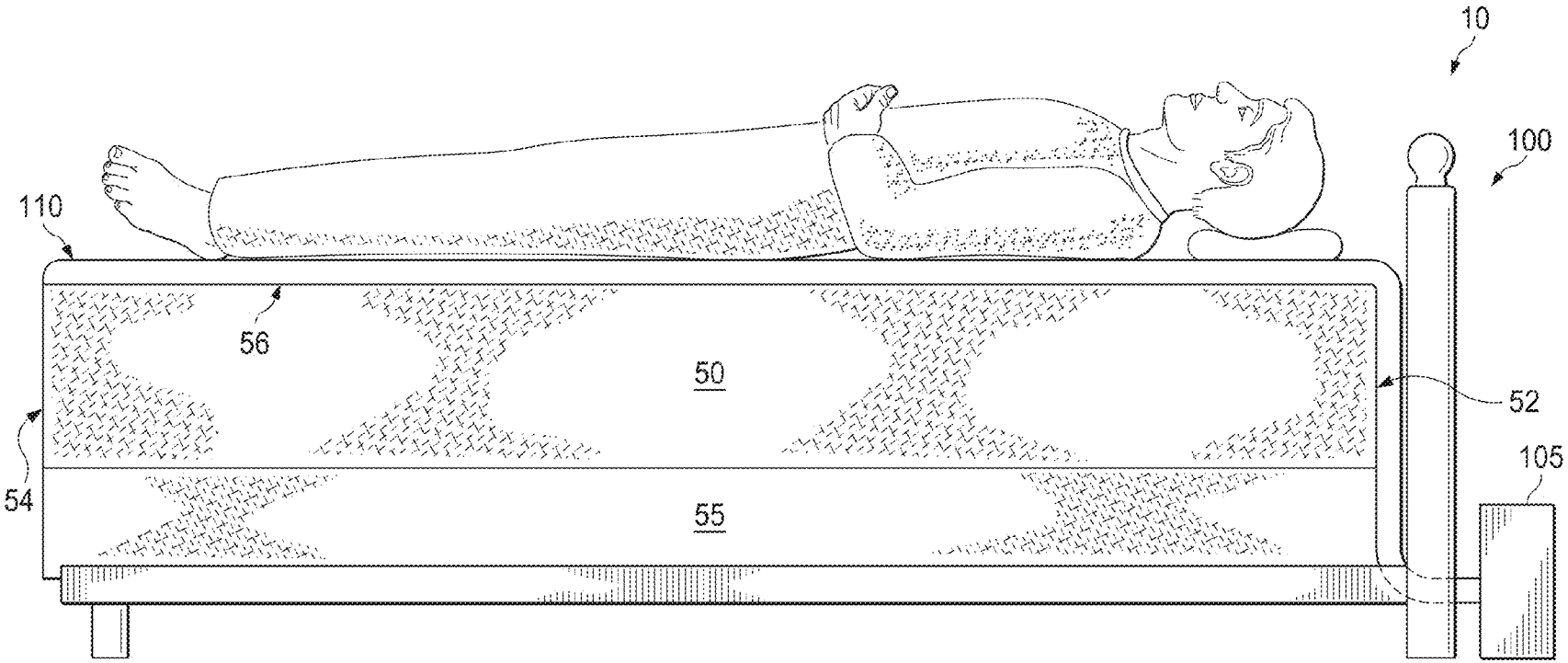
FIG. 1 illustrates an embodiment of a bed that includes a personal comfort system according to the present disclosure.

FIG. 1 illustrates a bed 10 that includes a personal comfort system 100 according to embodiments of the present disclosure. The embodiment of the bed 10 having the personal comfort system 100 shown in FIG. 1 is for illustration only and other embodiments could be used without departing from the scope of this disclosure. In addition, the bed 10 is shown for example and illustration; however, the following embodiments can be applied equally to other systems, such as, chairs, sleeping bags or pads, couches, futons, other furniture, apparel, blankets, and the like. In general, the embodiments of the personal comfort system are intended to be positioned adjacent a body to apply an environmental change on the body.

In the examples shown in FIG. 1, the bed 10 includes a mattress 50, a box-spring/platform 55 and the personal comfort system 100. The personal comfort system 100 is shown including a personal air conditioning control system 105 and a distribution structure or layer 110. The personal air conditioning control system 105 includes one or more axial fans or centrifugal blowers, or any other suitable air moving device(s) for providing air flow. In other embodiments, the personal air conditioning system 105 may include a resistive heater element or a thermal exchanger (thermoelectric engine/heat pump) coupled with the axial fan or centrifugal blower to provide higher/lower than ambient temperature air flow.

Hereinafter, the system(s) will be described with reference to "conditioned air," but it will be understood that when no active heating/cooling device(s) are utilized, the conditioned air flow is actually unconditioned (e.g., ambient air without increase/decrease in temperature).

As shown, the personal comfort system 100 includes a distribution layer 110 coupled to the personal air conditioning control system 105. The distribution layer 110 is adapted to attach and secure to the mattress 50 (such as a fitted top sheet), and may also be disposed on the surface of the mattress 50 and configured to enable a bed sheet or other fabric to be placed over and/or around the distribution layer 110 and the mattress 50. Therefore, when an individual (the user) is resting on the bed 10, the distribution layer 110 is disposed between the individual and the mattress 50.

The personal air conditioning control system 105 delivers conditioned air to the distribution layer 110 which, in turn, carries the conditioned air in channels therein. The distribution layer 110 enables and carries substantially all of the conditioned air from a first end 52 of the mattress 50 to a second end 54 of the mattress 50. The distribution layer 110 can also be configured or adapted to allow a portion of the conditioned air to be vented, or otherwise percolate, towards the individual in an area substantially adjacent to a surface 56 of the mattress 50.

It will be understood that the geometry of the distribution layer 110 coincides with all or substantially all of the geometry (or a portion of the geometry) of the mattress 50. The distribution layer 110 can include two (or more) substantially identical portions enabling two sides of the mattress to be user-controlled separately and independently. In other embodiments, the system 100 can include two (or more) distinct distribution layers 110 similarly enabling control of each separately and independently. For example, on a queen or king size bed, two distribution layers 110 or two spacer fabric panels are provided for each half of the bed. Each are controlled with separate control units or with a single control unit configured to separately and independently control each distribution layer 110, and in another embodiment, are remotely controlled using one or two handheld remote control devices. Control units and other mechanisms to control and operate the personal air conditioning control system 105 are disclosed in U.S. patent application Ser. No. 13/954,762, filed on Jul. 30, 2013 and titled "SYSTEM AND METHOD FOR THERMOELECTRIC PERSON COMFORT CONTROLLED BEDDING" which is incorporated herein by reference in its entirety.

The distribution layer 110 can be utilized in different heating/cooling modes. In a passive mode, the distribution layer 110 includes an air space between the user and the top of the mattress which facilitates some thermal transfer. No active devices are utilized. In a passive cooling mode, one or more fans and/or other air movement means cause ambient air flow through the distribution layer 110. In an active cooling/heating mode, one or more thermoelectric devices are utilized in conjunction with the fan(s) and/or air movement devices.

One example of a thermoelectric device is a thermoelectric engine or cooler (TEC). In an active cooling mode with resistive heating, one or more thermoelectric devices are utilized for cooling in conjunction with the fan(s) and/or air movement devices. In this same mode, a resistive heating device is introduced to work with fan(s) and/or air movement devices to enable higher temperatures. This mode can also utilize a thermoelectric device. The resistive heating device can be a printed circuit trace on a thermoelectric device, a PTC (positive temperature coefficient) type device, or some other suitable device that generates heat.

As will be understood by those skilled in the art, each of the personal air conditioning control systems described herein can be utilized in any of the different heating/cooling modes including a passive cooling mode, an active cooling/heating mode, and active cooling mode with resistive heating.

Figure 2A:
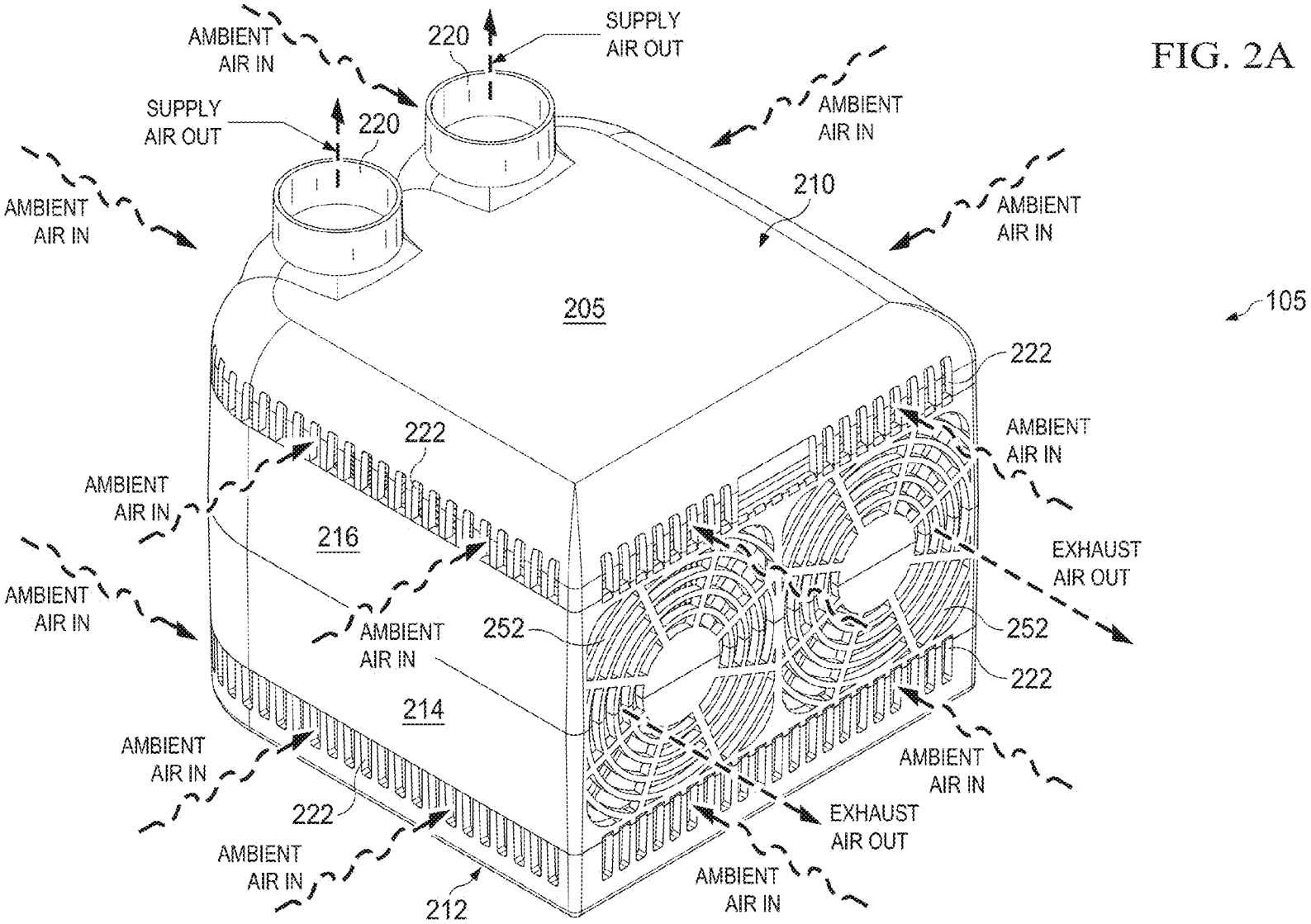
FIGS. 2A and 2B illustrate embodiments of the personal air conditioning control system according to the present disclosure.
Figure 2B:
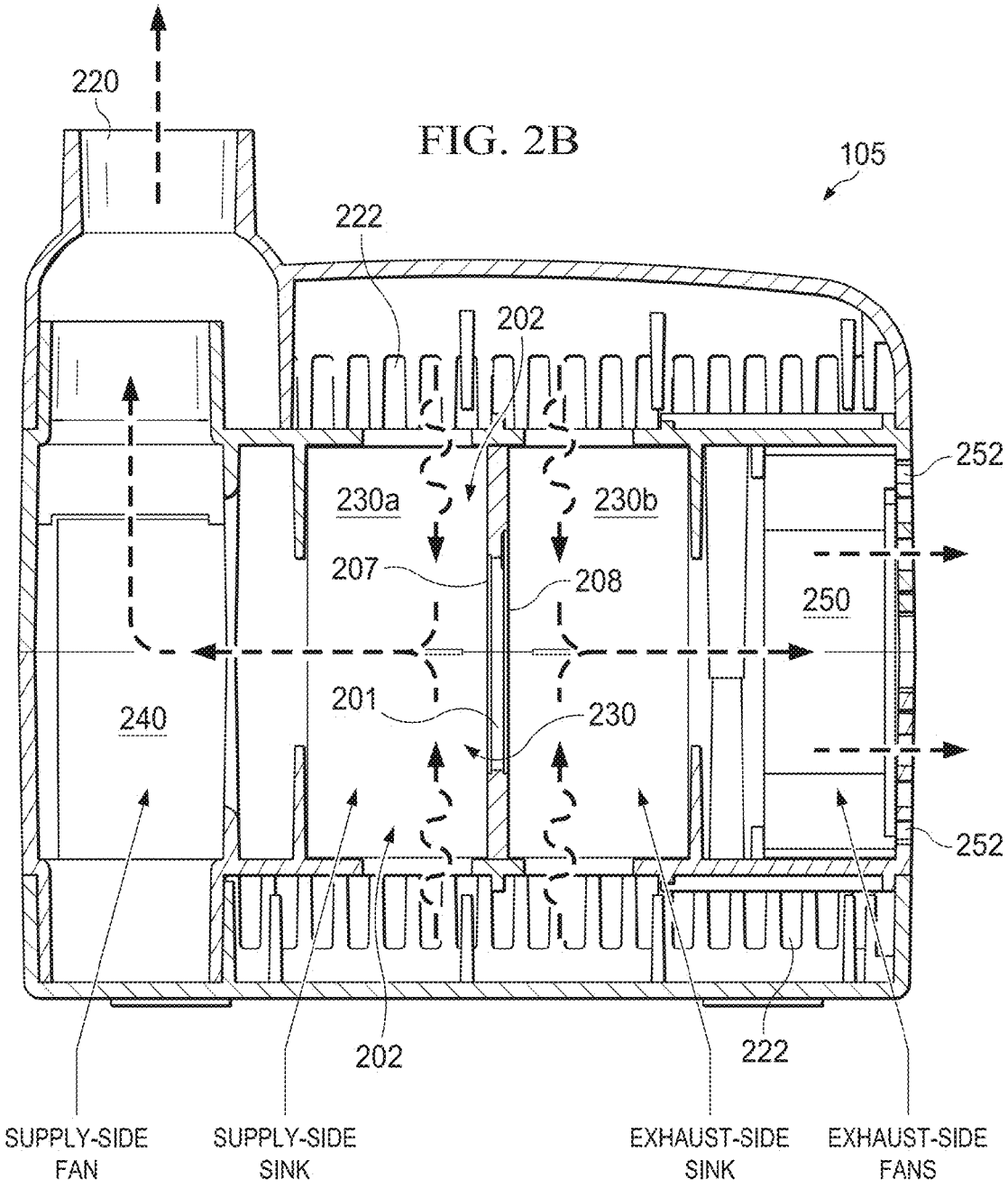

Now turning to FIGS. 2A and 2B, there is illustrated an embodiment of the personal air conditioning control system 105 according to this disclosure. In this embodiment, the system 105 includes one or more thermal transfer device assemblies (such as thermoelectric heat pump or thermoelectric cooler (TEC) assemblies) 201.

The personal air conditioning control system 105 is configured to deliver conditioned air to the distribution layer 110 (or a distribution system (not shown)). As shown in FIG. 2A, the personal air conditioning control system 105 includes a housing 205 (that is generally rectangular in shape). The housing 205 is formed of multiple components, including a top cover 210, a bottom tray 212, a first center section 214 and a second center section 216. These four components are designed to be easily assembled or mated to form the housing 205, such as a clamshell-type design. In this embodiment, the two center sections 214 and 216 are identical.

The top cover 210 includes two or more supply outlets 220 for supplying conditioned air to the distribution layer 110. Multiple ambient air inlets 222 positioned along the peripheries of the top cover 210 and the bottom tray 212 allow ambient air to enter internal chambers 230 (one internal chamber for each supply outlet 220) that are divided into a supply side chamber 230*a* and an exhaust side chamber 230*b* (as shown in FIG. 2B).

Furthermore, each internal chamber 230 is separated with a wall or barrier 202. The barrier 202 is configured to isolate or separate the supply air flow paths through the internal chamber 230 for each supply outlet 220. For example, a barrier 202 is configured to separate air flow so that a first supply outlet 220 supplies cool air (or relatively cooler air) to a first distribution layer 110 while a second supply outlet 220 supplies warmer air (or relatively warmer air) to a second distribution layer 110. The barrier 202 is configured to prevent or at least minimize the mixing of air being conditioned in a supply side chamber 230*a* associated with a first supply outlet 220 with air being conditioned in a supply side chamber 230*a* associated with a second supply outlet 220. The barrier 202 is also configured to prevent or at least minimize the mixing of conditioned air flowing from the supply side chamber 230*a* associated with a first supply outlet 220 through the first supply outlet 220 with conditioned air flowing from the supply side chamber 230*a* associated with a second supply outlet 220 through the second supply outlet 220. One or more thermal heat transfer device assemblies (such as TEC assemblies) 201 is positioned within each of the chambers 230. In an embodiment, a thermal heat transfer device assembly 201 with more than one thermal heat transfer device extends through the barrier 202 into each separated internal chamber 230 such that at least one thermal heat transfer device conditions air in each supply air flow path associated with each supply outlet 220.

One or more supply side fans 240 for air flow paths associated with each supply outlet 220 (separated by the barrier 202) function to draw air through the inlets 222 and into the supply side chambers 230*a* where the air is cooled by the supply side sink 207 (cold side) and force the cooled conditioned air through supply outlet 220. Similarly, one or more exhaust side fans 250 function to draw air through the inlets 222 and into the exhaust side chamber 230*b* where the air is heated by the exhaust side sink 208 (hot side) and force the heated air out into the ambient through exhaust vents 252.

The embodiment of the system 105 may be more beneficial due to its reduced size and decreased assembly complexity. In this embodiment, the two center sections 214 and 216 are identical and have integrated fan guards. Though not shown, the system 105 typically will include one or more filters positioned therein to filter particles or other impurities from the air flowing into the inlets 222. By dividing the intake air to flow in from both the top and the bottom, the pressure drop to the respective fans is reduced and fan noise is reduced.

By drawing air near, through or over the bottom tray 212, any condensate that forms and collects within a condensate collection tray (not shown) located in the bottom tray 212 can be evaporated by the intake air flow. In this embodiment, no wicking material may be necessary, though it can optionally be included therein.

As with the other embodiments, the system 105 further includes a power supply and/or power adapter (not shown) and a control unit operable for controlling the overall operation and functions of the system 105. The control unit is configured to communicate with one or more external devices or remotes via a Universal Serial Bus (USB) or wireless communication medium (such as Bluetooth®) to transfer or download data to the external devices or to receive commands from the external device. The control unit includes a power switch adapted to interrupt one or more functions of the system 105, such as interrupting a power supply to the blowers/fans. The power supply is adapted to provide electrical energy to enable operation of the heat transfer device(s), the blowers/fans 240 and 250, and remaining electrical components in the system 105. The power supply and/or power adapter operates at an input power between 2 watts (W) and 200 W (or at 0 W in the passive mode). The control unit is configured to communicate with a second control unit in a second system 105 operating in cooperation with each other.

Figure 3B:
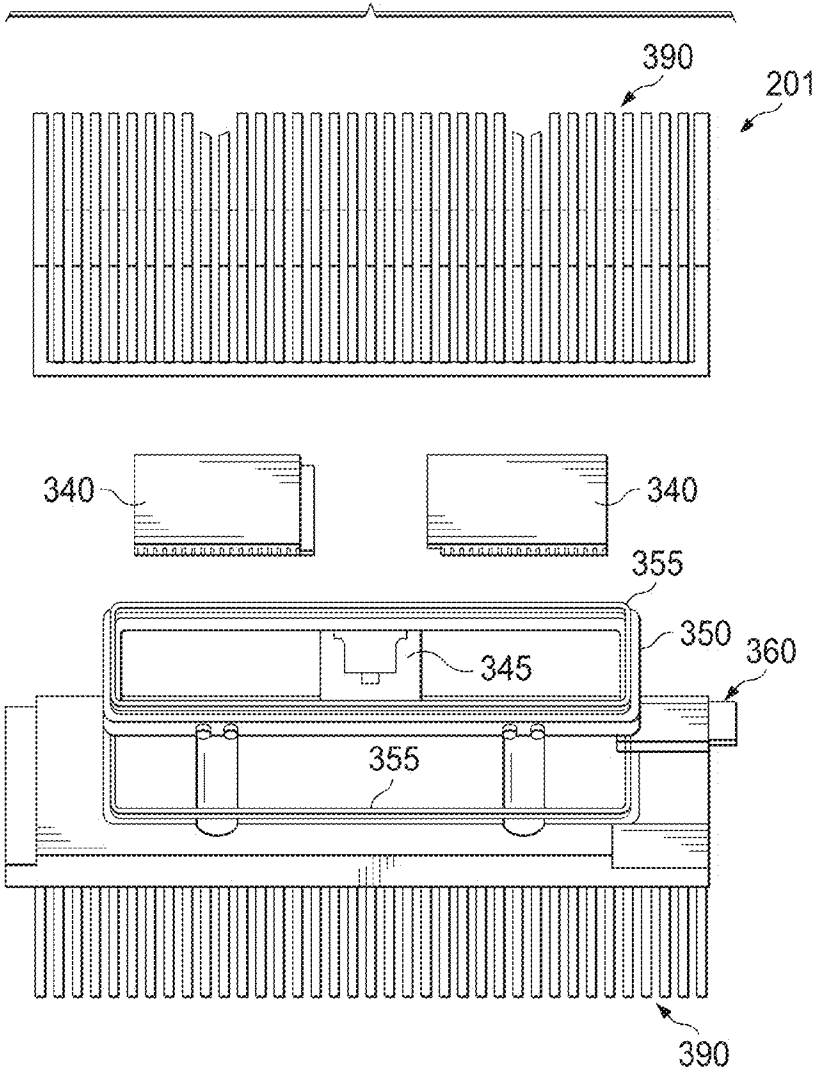
FIGS. 3A and 3B illustrates an embodiment of a thermal heat transfer device assembly according to the present disclosure.
Figure 3A:
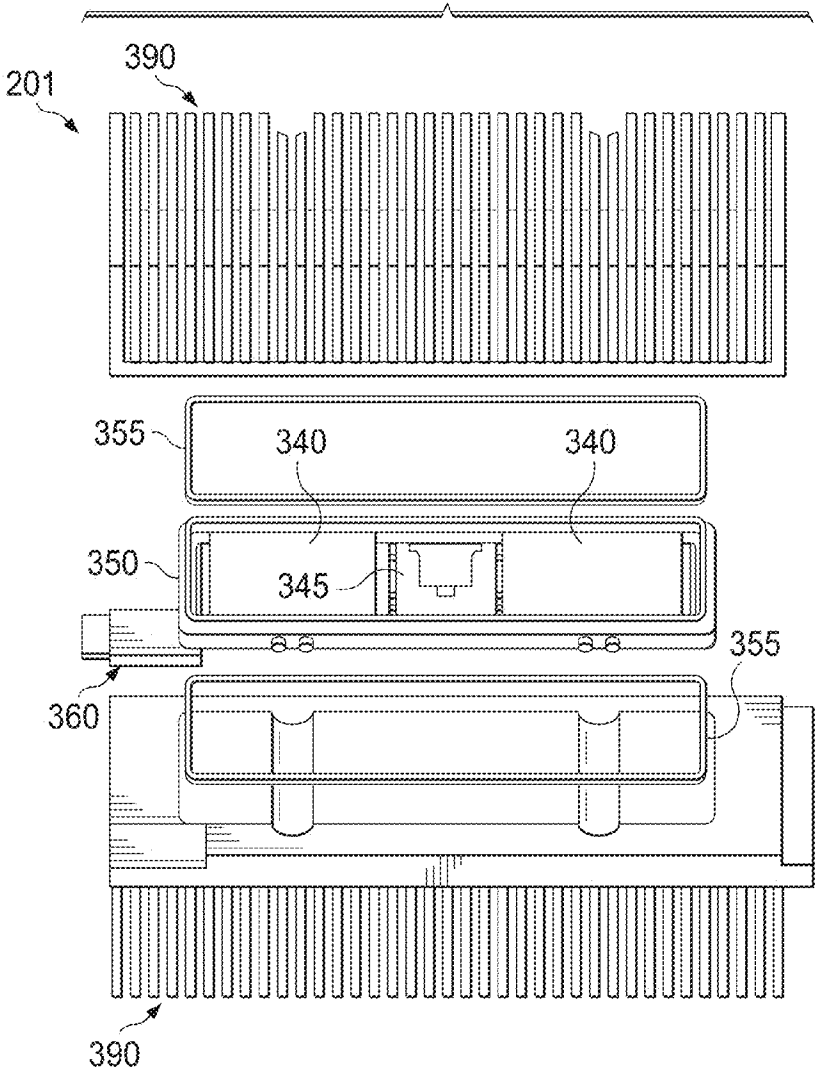

Now turning to FIGS. 3A and 3B, there are illustrated two different exploded views of an embodiment of the TEC assembly 201 according to this disclosure. The assembly 201 includes one or more thermal transfer devices (such as TECs) 340, a printed circuit board (PCB) 345 disposed between the TECs 340, a mold substrate 350, two sealing gaskets 355 (for example, two for each mold substrate 350) and a connector header PCB 360. Also shown are hot/cold side heat exchangers 390 that will be thermally coupled to the surfaces of the TECs 340 such that the assembly 201 will be disposed therebetween. It should be noted that while FIGS. 3A and 3B illustrate that TEC assemblies 201 include two thermal transfer devices 340, the TEC assemblies 201 can include one thermal transfer device 340 or three or more thermal transfer devices 340.

In an embodiment, the TEC assembly 201 includes a plurality of mold substrates 355 each with one or more thermal transfer devices (such as TECs) 340, a PCB 345, sealing gaskets 355, and a connector head PCB 360. For example, TEC assembly 201 from FIG. 3A can be placed into a first supply air flow channel of a personal air conditioning control system 105 and TEC assembly 201 from FIG. 3B can be placed into a second supply air flow channel of the personal air conditioning control system 105. In an embodiment, the mold substrate 355 can be a single continuous mold substrate nesting and sealing each of the thermal transfer devices 340 of FIGS. 3A and 3B. The thermal transfer devices 340 from FIG. 3A can independently condition air in the first supply air flow channel while the thermal transfer devices 340 from FIG. 3A can independently condition air in the second supply air flow channel. In some embodiments, one side of each of the thermal transfer devices 340 is exposed to a supply air channel while another side of each of the thermal transfer devices 340 is exposed to an exhaust flow channel of the personal air conditioning control system 105.

Figure 4A:
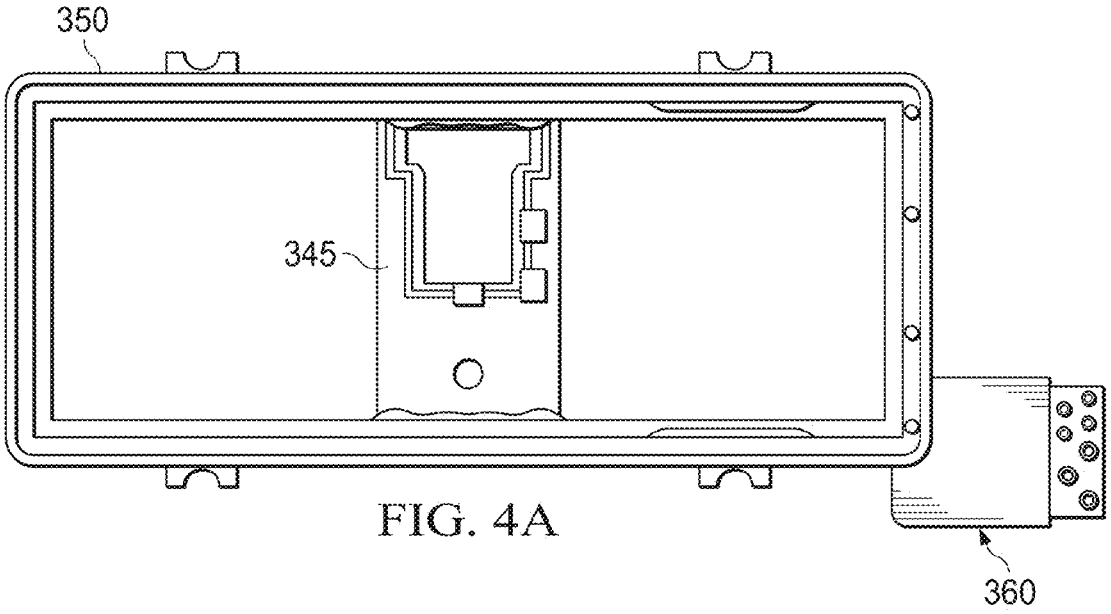
FIGS. 4A and 4B illustrate embodiments of a mold and printed circuit board (PCB) according to the present disclosure.
Figure 4B:
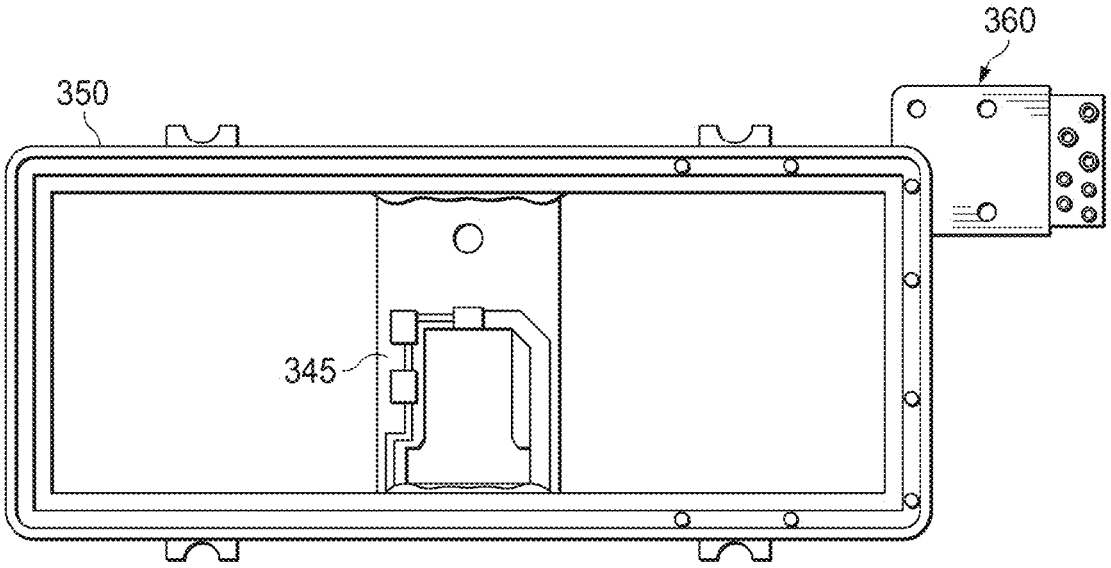

Turning to FIGS. 4A and 4B, there are illustrated front and back views of an embodiment of the PCB 345 secured within the mold substrate 350. As will be appreciated, the TECs 340 are omitted from the FIGURES. The mold substrate 350 is also configured to secure the connector header PCB 360 as shown.

Figure 5A:
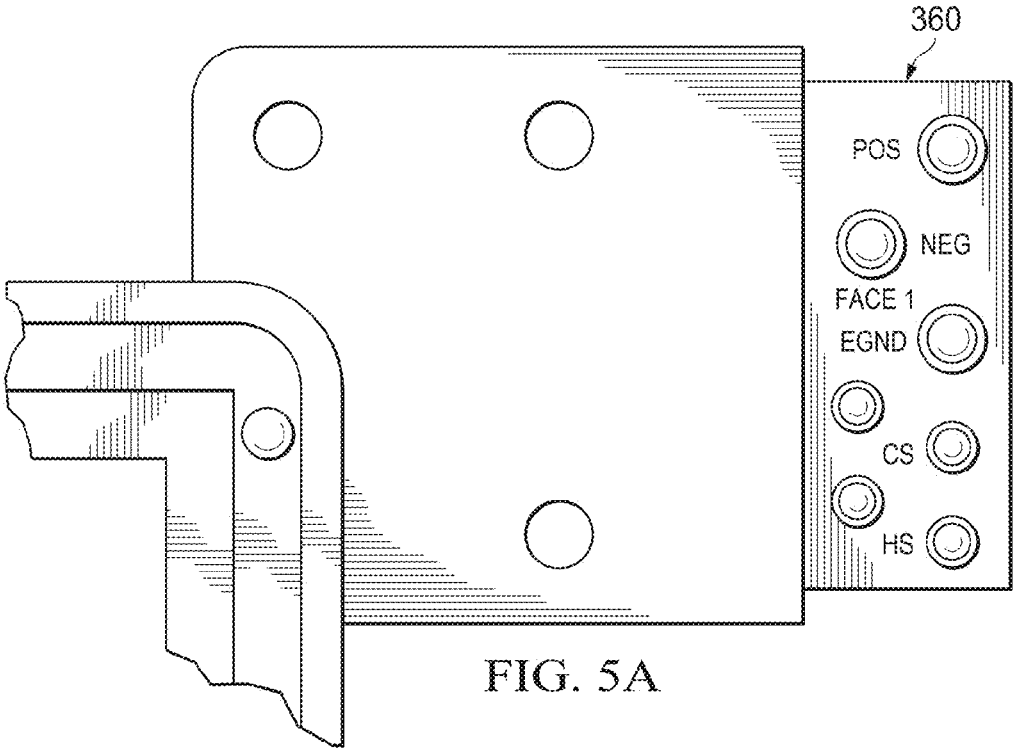
FIGS. 5A and 5B illustrate embodiments of a connector header according to the present disclosure.
Figure 5B:
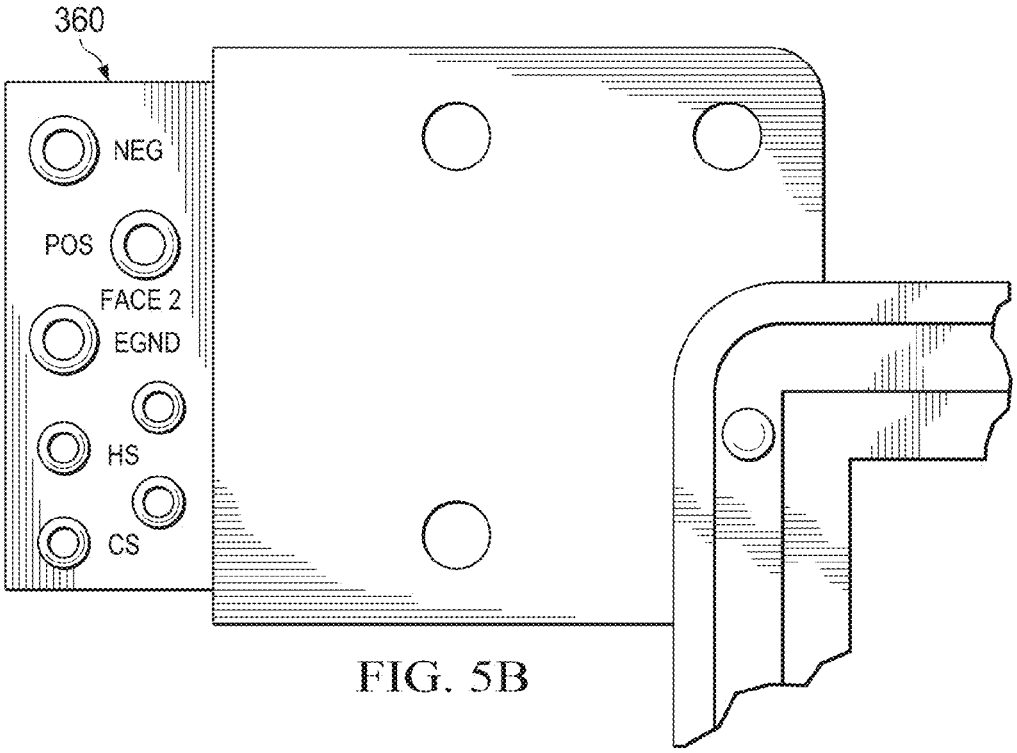
Figure 6A:
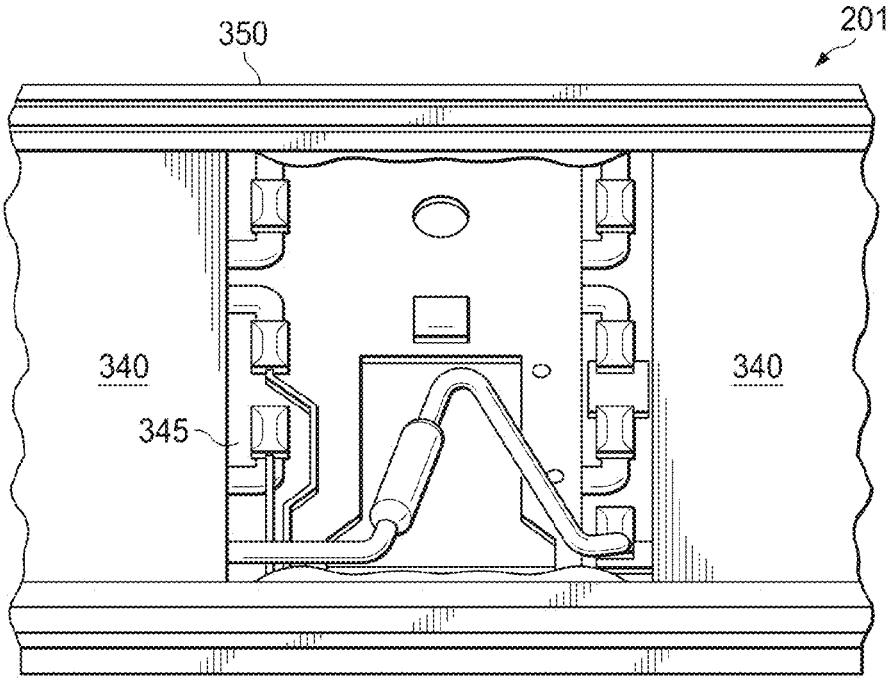
FIGS. 6A and 6B illustrate embodiments of a thermal heat transfer device assembly according to the present disclosure.
Figure 6B:
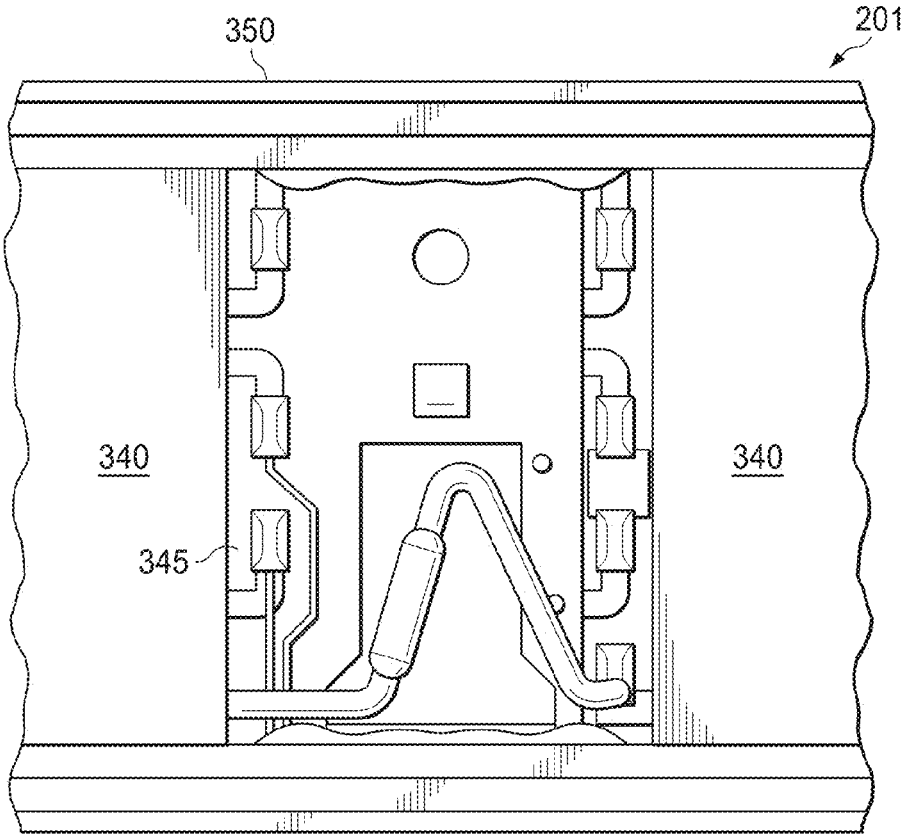

The PCB 345 is configured to provide electrical connections between the two TECs 340. These electrical connections are disposed within/on the PCB 345 in the form of electrical conductors (metal conductors) and/or connector terminals. As will be appreciated, the PCB 345 may be constructed or configured to carry other electrical components (active/passive electrical components, integrated circuits, etc.), as desired. For example, electrical leads of the TECs 340, temperature sensor leads, thermal fuse leads, or the like can be connected to the PCB 345, and can be connected to the connector header PCB 360. FIGS. 5A and 5B illustrate embodiments of a connector header 360 according to this disclosure. The PCB 345 is configured to allow electrical current to pass through it FIGS. 6A and 6B illustrate embodiments of the PCB 345, for example when electrically connected to a TEC 340, according to this disclosure.

The mold substrate 350 is configured to over-mold the PCB 345. For example, over-mold can mean that the mold substrate 350 forms over one or more ends of the PCB 345 so that the PCB 345 is retained by the mold substrate 350. The mold substrate 350 includes a polymer material. The mold substrate 350 also includes glass or glass fragments in order to increase the creep resistance of the mold substrate 350.

The mold substrate 350 is configured to surround edges of the one or more TECs 340. For example, the mold substrate 350 is configured to cover at least a portion of the perimeter of the planar surfaces of the one or more TECs 340. The mold substrate 350 in cooperation with the two sealing gaskets 355 is configured to form a seal with the planar surfaces of the one or more TECs 340 having suitable surface topology. The two sealing gaskets 355 can be disposed in a recess (or on a seat) of the planar surfaces of the TEC 340 and/or a recess (or seat) in the mold substrate 350. Furthermore, sealing between a mold substrate 350 and a TEC 340 can be accomplished by any components or methods known to those skilled in the art.

Figure 7A:
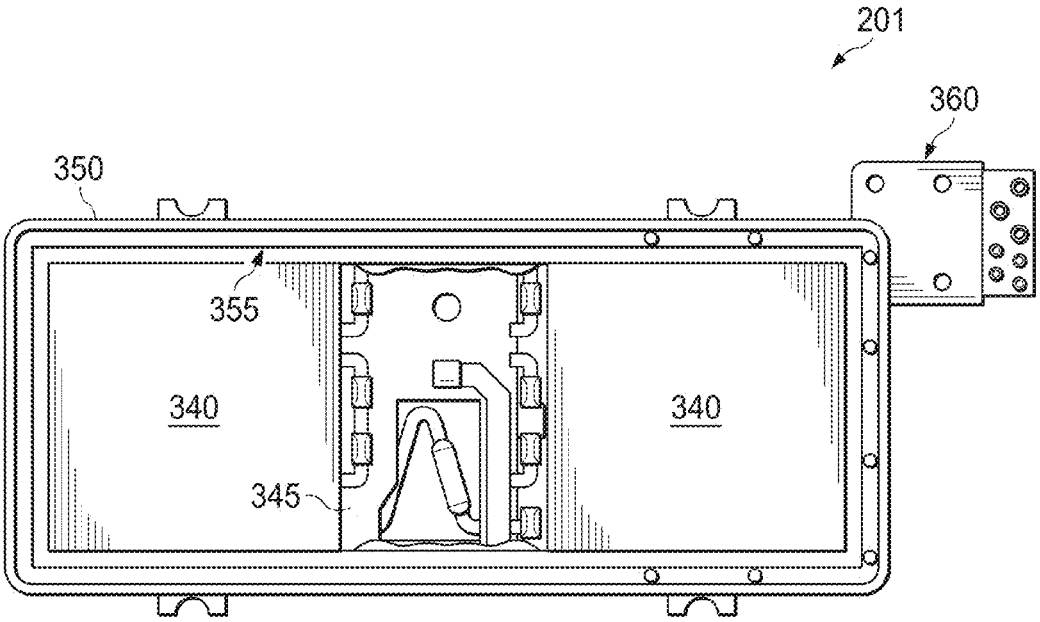
FIGS. 7A and 7B illustrate embodiments of a thermal heat transfer device assembly according to the present disclosure.
Figure 7B:
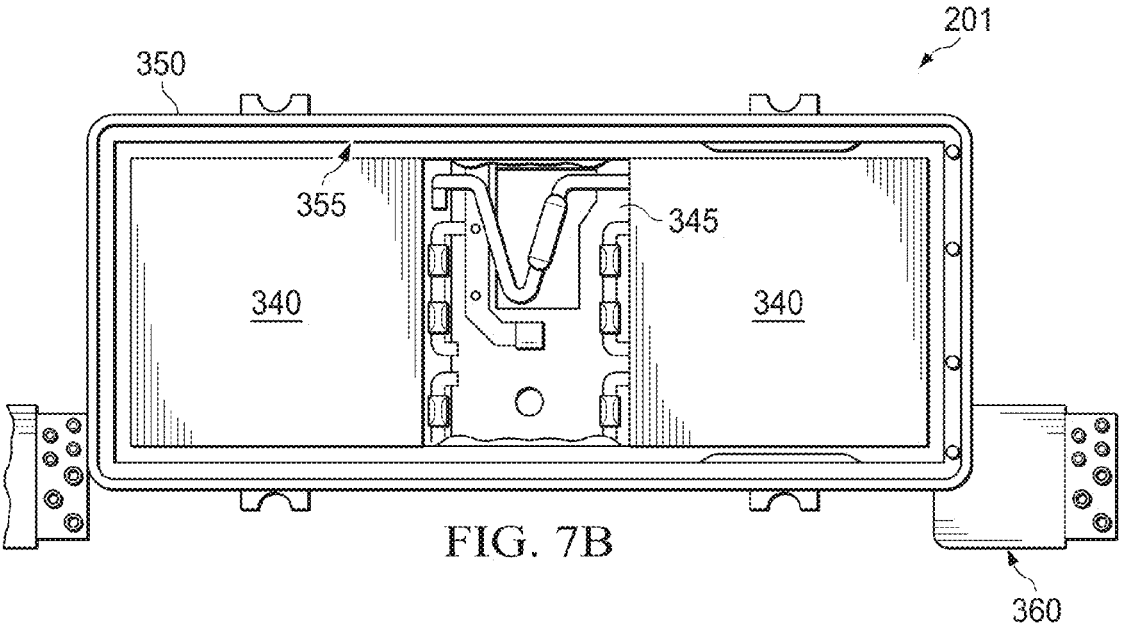

For example, as illustrated in FIGS. 7A and 7B, the mold substrate 350 surrounds edges of TECs 340 electrically connected to the PCB 345. A sealing gasket 355 is disposed between a first planar surface of the TEC 340 and the portion of the mold substrate 350 adjacent to the first planar surface of the TEC 340. Another sealing gasket 355 is disposed between a second planar surface of the TEC 340 and the portion of the mold substrate 350 adjacent to the second planar surface of the TEC 340. The two sealing gaskets 355 form a seal when the assembly 201 is torqued so that the glands of the sealing gaskets 355 are sufficiently crushed to minimize water vapor ingress into the TEC 340.

Figure 8A:
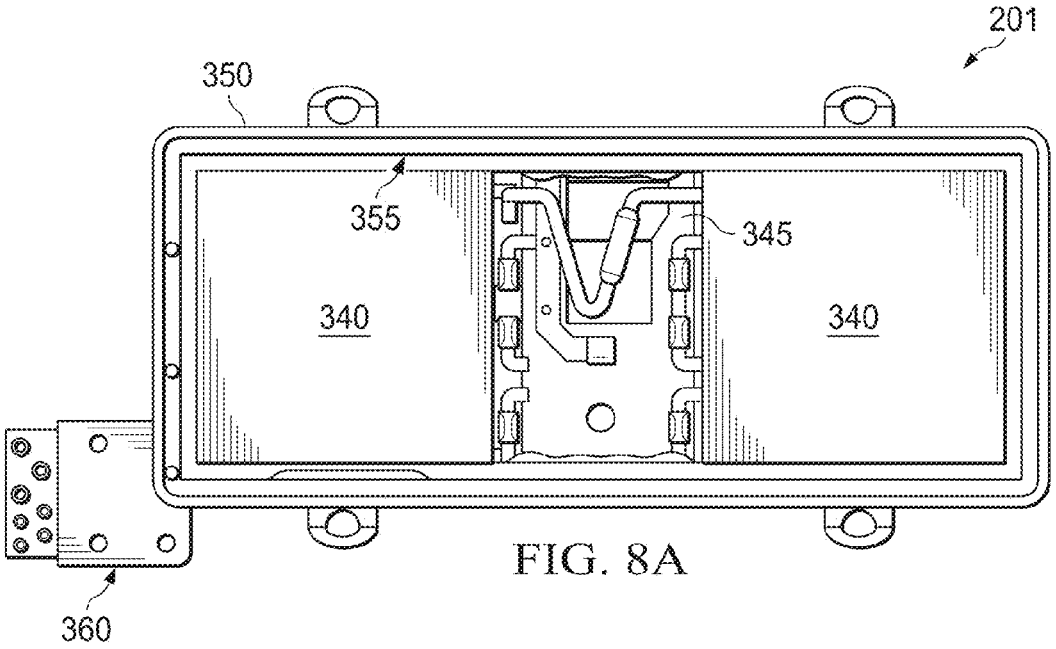
FIGS. 8A and 8B illustrate embodiments of a thermal heat transfer device assembly according to the present disclosure.
Figure 8B:
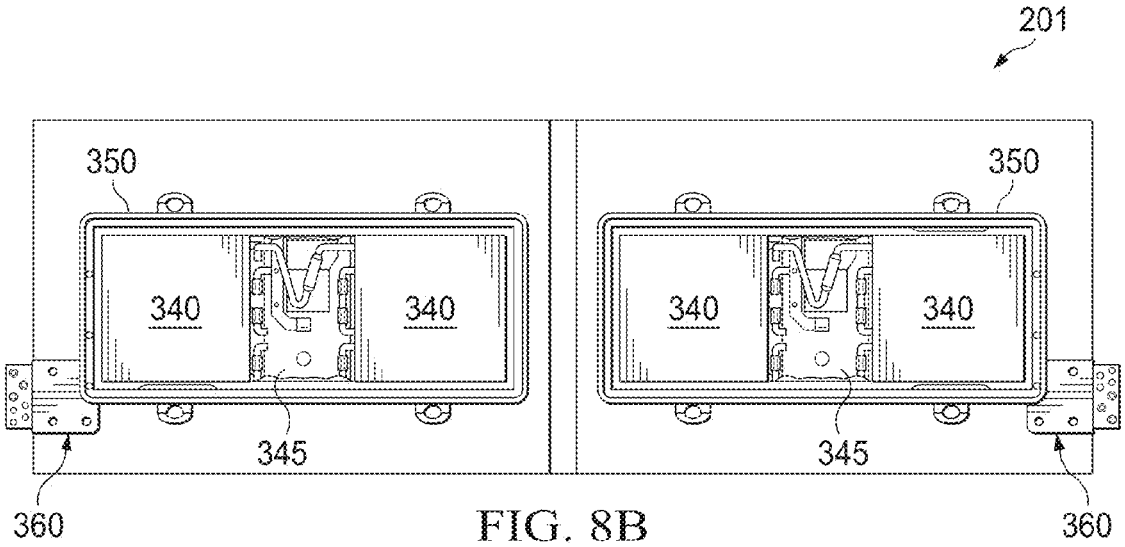

FIGS. 8A and 8B illustrate additional embodiments of an assembly 210 according to the present disclosure. The embodiments disclosed herein can use an over-molded PCB as both an electrical pass-through, and an o-ring sealing surface. The over-molded PCB reduces the assembly cost by eliminating the need for secondary internal and external PCB's.

As will be appreciated, FIG. 8A illustrates a TE system having two separate TECs 340 having a single common side exhaust exchanger (see, for example, FIG. 3). However, these TECs are controlled collectively and both TECs 340 operate in tandem in either a heating mode or a cooling mode. FIG. 8B illustrates a TE system having two sets of TECs in which each set has two individual TECs. In this configuration, each set may utilize a single common side exhaust exchanger for its two TECs, but the two sets each have their own separate (thermally separated) exhaust side exchanger (see, for example, FIG. 3). However, each set of TECs is controlled individually, and the two sets can operate in either a heating mode or a cooling mode. In this configuration, the two sets of TECs may utilize their separate exhaust side exchangers within a common side air exhaust chamber, with their separate individual supply side exchangers utilized within separate supply side air chambers.

FIG. 9 illustrates test conditions and test results of an embodiment of the assembly 201 according to this disclosure. As illustrated in FIG. 9, vapor ingress testing found that $1/50^{th}$ of the water vapor that ingresses into an assembly using PIE, ingresses into the TEC 340 of the assembly 201. Furthermore the assembly 201 allows for more parasitic heat transfer than using polyisobutylene (PIB). Thus, in an embodiment, the size of the surface area of the sealing gasket 355 in contact with a planar surface of a TEC 340 is configured (for example by changing or reducing the surface area of the sealing gasket 355) to minimize parasitic heat transfer.

Figure 10A:
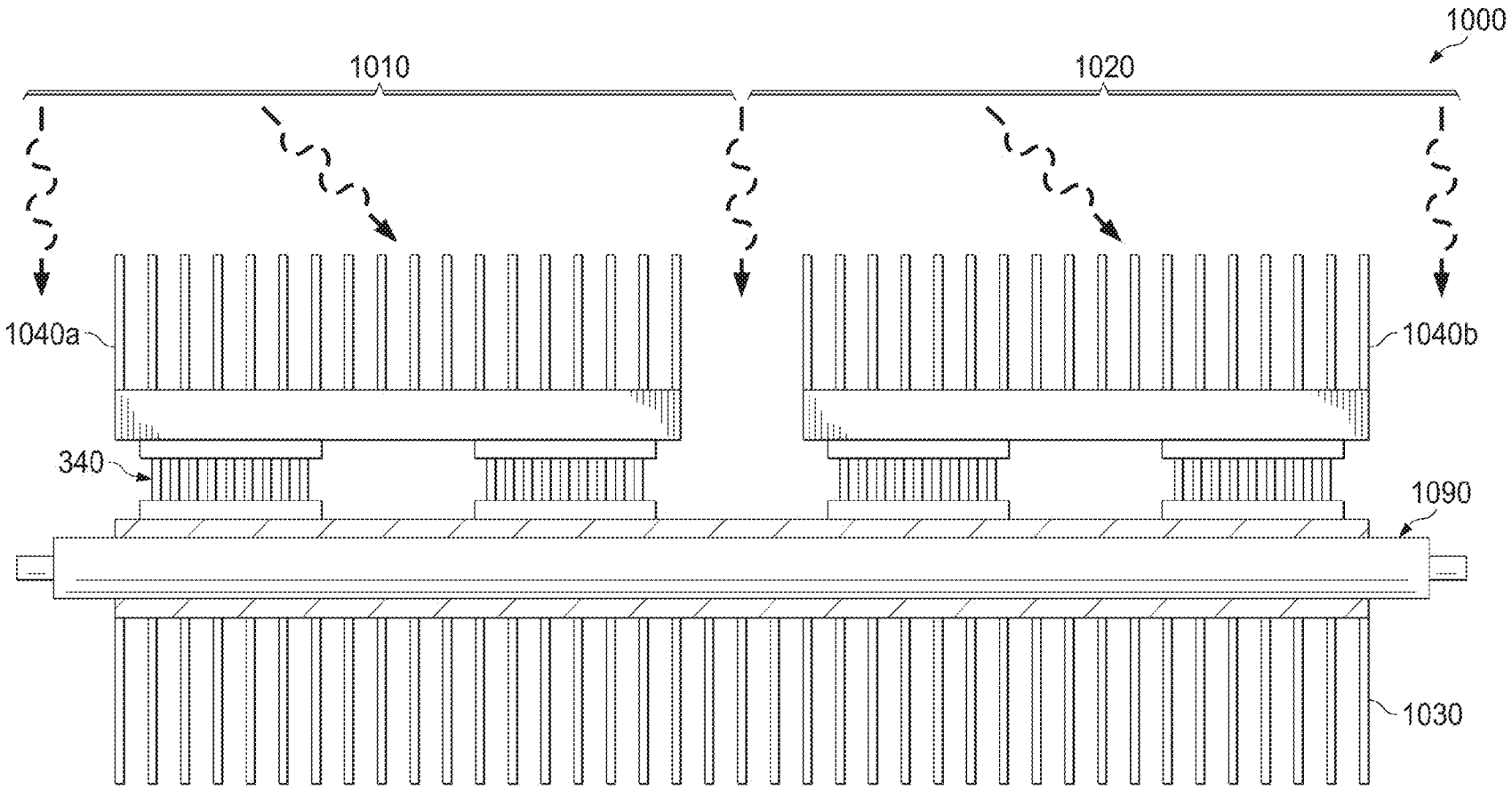
FIGS. 10A-10D illustrates an embodiment of a TE system in accordance with the present disclosure.
Figure 10B:
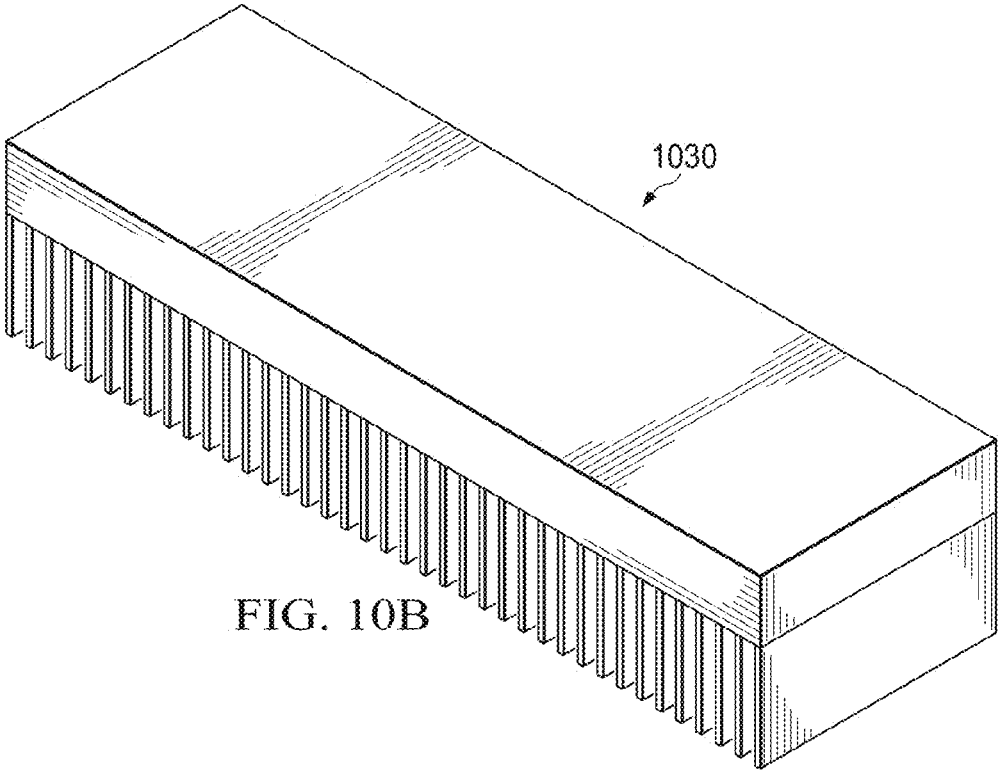

Now turning to FIGS. 10A through 10D, there is shown embodiments of a thermaloelectric engine (TE). As shown in FIG. 10A, the TE is dual core personal comfort engine (PCE) 1000 having two separately controlled sets of TE devices 1010, 1020, with each set (or core) having two TECs 340 configured with a single common hot side exchanger (e.g., hot side) 1030 and individual supply side heat exchangers (e.g., cold side) 1040*a*, 1040*b*. FIG. 10B illustrates a common hot side exchanger 1030 according to the present disclosure.

The PCE 1000 provides an improved TE dual core design based on the use of a single hot side exchanger 1030 that is common to and in direct thermal communication with two, separate cores or devices 1010 and 1020, each with two TECs 340. Attached to the opposite sides of the TECs 340 are individual cold side exchangers 1040*a*, 1040*b* which complete the dual core assembly. Each core 1010, 1020 is controlled independently and can operate in either cooling or heating modes.

In another embodiment, the common side heat exchanger 1030 includes one or more fluid conduits 1090 disposed within (or in contact with) the common hot side exchanger 1030 to increase lateral thermal conduction and communication between the two cores 1010, 1020.

Figure 10C:
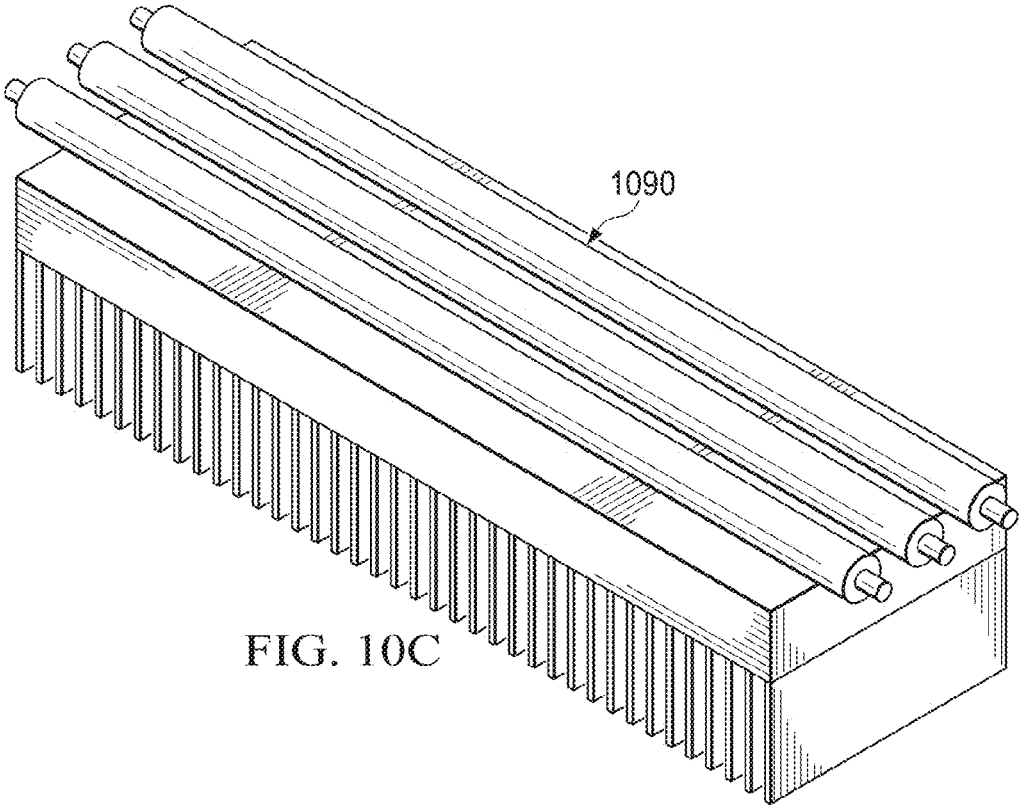

The PCE 1000, when incorporated into a housing and control system such as that described herein (e.g., FIG. 2) and as described and illustrated in U.S. patent application Ser. No. 14/624,469 filed on Feb. 17, 2015 and which is fully incorporated herein by reference in its entirety, provides a system where two independent air streams (cores) that are generated by concurrent thermally opposite operations of the cores 1010, 1020, with one in a heating mode and the other in a cooling mode. In this example, the rejected heat from the cooling side of one core is conducted through the common hot side exchanger 1030 to the heating side of another core. This also includes the use of fluid conduits 1090 to more actively transfer or conduct the heat from one area of the exchanger 1030 to another area. As a result, the net improvement is that the cooling side has an effective lower hot side thermal resistance beyond that which can be achieved by forced convection alone. In essence, the cooling side core is turned into a quasi-two stage planar TEC. FIG. 10C illustrates an example of fluid conduits 1090 in a common hot side exchanger 1030 according to the present disclosure.

The heating side core benefits from the additional thermal energy now available, which in turn, is pumped through the TECs and into the air stream via the exchanger (1040*a* or 1040*b*). Performance improvements increase as both cores approach their maximum and opposite input powers. Performance also improves in a mode in which only one core is active since the entire common hot side exchanger 1030 can be utilized.

In an embodiment, each exchanger 1030, 1040*a*, 1040*b* can be of the finned type, and can be any style or configuration, such as for example, extruded, skived, bonded, soldered, and the like, and can be constructed of aluminum, copper, other metals, or any other suitable like material of high thermal conductivity (including combinations thereof).

Figure 10D:
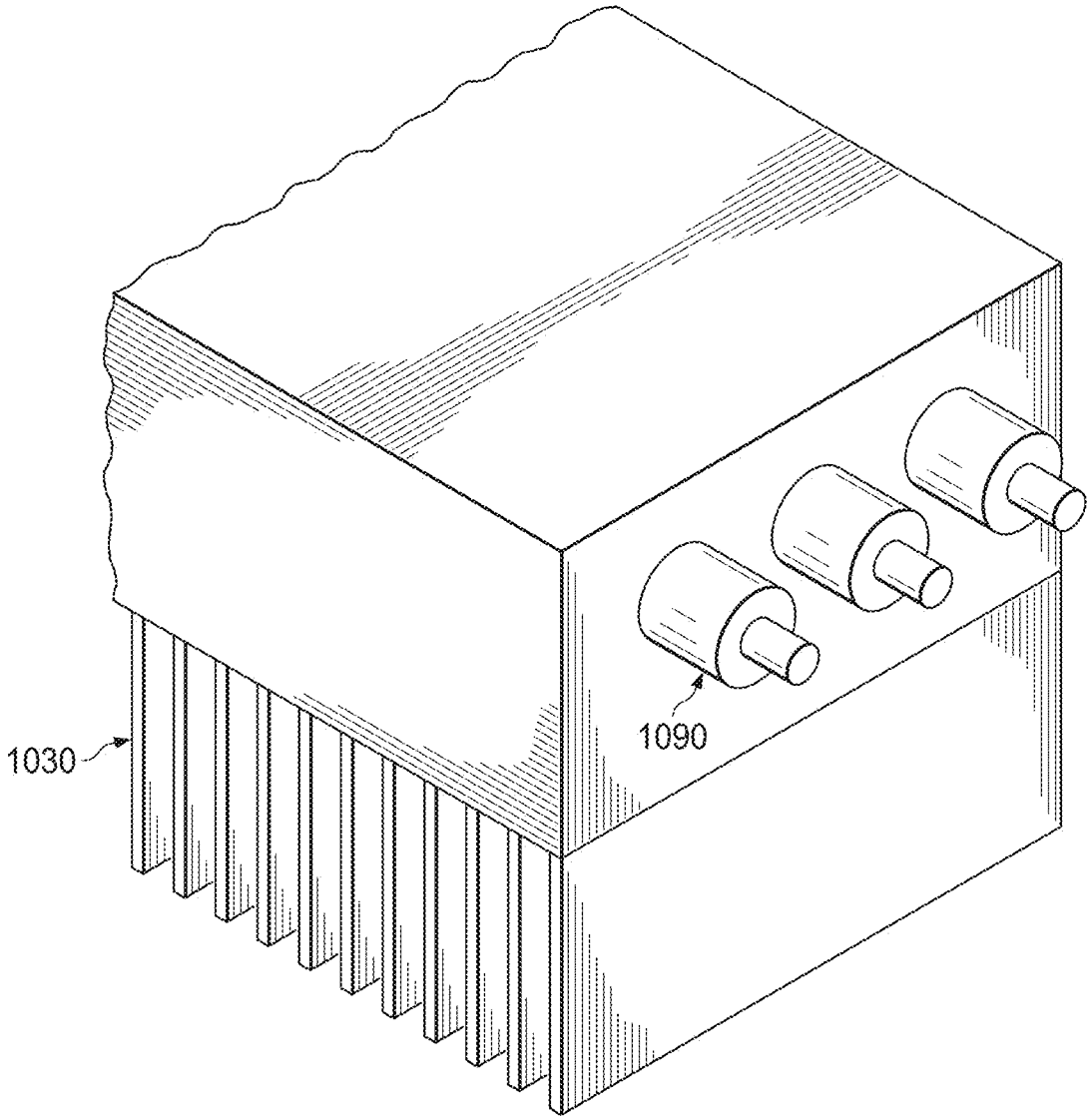

FIG. 10D illustrates an example of the fluid conduits 1090 (i.e., heat pipes) are embedded into the base of the hot side exchanger 1030 to improve lateral heat spreading along the longitudinal axis. The heat pipes can be of the conventional "wick" design or construction utilizing copper, aluminum or other metal for the pipe and charged with a compatible working fluid, e.g., refrigerants, solvents, water, etc. Suitable fluid conduits are commercially available and can be customized for the application. Thermal interfacing of the fluid conduits and hot side exchanger are made through epoxies, solders, mechanical methods or brazing. In another embodiment, the fluid conduits are simply passages formed within in the heat exchanger 1030.

The PCE 1000 provides a dual core TE engine design with a single (common) hot side exchanger (with or without embedded fluid conduits). Each of the multiple cores are independently temperature controlled. In addition, two cores can operate in opposite modes (one core operates in a heating mode while another core can operates in a cooling mode) which improves thermal performance of the cores. Further, the PCE 1000 provides improved thermal performance when only one core is operating (where the entire hot side exchanger 1030 is used more effectively for the single operating core).

The PCE 1000 can be utilized or incorporated for use in different applications, such as a bedding, seating or other personal comfort application. In addition, any application that requires or benefits from a system that provides both cooled and heated fluids within close proximity can utilize the PCE 1000. For example, in the food service industry, the PCE 1000 can be beneficially utilized in an application where cold food and hot food are maintained in close proximity, such as heated and cooled food displays (side by side).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A thermoelectric-based air conditioning system comprising:

at least a first supply air channel and a separate second supply air channel disposed in a housing;

a first thermoelectric cooler (TEC) assembly forming at least a portion of the first supply air channel and configured to independently condition air within the first supply air channel, the first TEC assembly including a first set of TECs and a first supply side heat exchanger operably connected to a supply side of the first set of TECs;

a second TEC assembly forming at least a portion of the second supply air channel and configured to independently condition air within the second supply air channel, the second TEC assembly including a second set of TECs and a second supply side heat exchanger operably connected to a supply side of the second set of TECs; and a single heat exchanger configured to transfer heat with exhaust sides of both the first set of TECs in the first TEC assembly and the second set of TECs in the second TEC assembly.

2. The thermoelectric-based air conditioning system of claim 1, wherein the first supply air channel is configured to independently supply conditioned air to a first air distribution layer, and wherein the second supply air channel is configured to independently supply conditioned air to a second air distribution layer.

3. The thermoelectric-based air conditioning system of claim 1, wherein the single heat exchanger is exposed to at least one exhaust air channel separate from the first supply air channel and the second supply air channel and configured to communicate heat with the single heat exchanger.

4. The thermoelectric-based air conditioning system of claim 1, wherein at least one of the first supply air channel and second supply air channel is configured to supply air to one of a bed, a chair, a sleeping bag, a sleeping pad, a couch, a futon, an article of clothing, or a blanket.

5. The thermoelectric-based air conditioning system of claim 1, wherein the first TEC assembly comprises two TECs and the second TEC assembly comprises two TECs.

6. The thermoelectric-based air conditioning system of claim 1, further comprising a controller configured independently control the first TEC assembly to condition air in the first supply air channel and independently control the second TEC assembly to condition air in the second supply air channel.

7. The thermoelectric-based air conditioning system of claim 1, further comprising a first supply fan configured to communicate air through the first supply air channel and a second supply fan configured to communicate air through the second supply air channel.

8. The thermoelectric-based air conditioning system of claim 1, wherein one or more fluid conduits extend through at least a portion of the single heat exchanger.

9. A thermoelectric cooler (TEC) system comprising: a first TEC assembly configured to independently condition air within a first supply air channel, the first TEC comprising: a first supply outlet forming at least a portion of the first supply air channel, and a first set of TECs and a first supply side heat exchanger operably connected to a supply side of the first set of TECs; a second TEC assembly configured to independently condition air within a second supply channel, the second TEC assembly comprising: a second supply outlet forming at least a portion of the second supply air channel, and a second set of TECs and a second supply side heat exchanger operably connected to a supply side of the second set of TECs; and a single heat exchanger configured to transfer heat with exhaust sides of both the first set of TECs in the first TEC assembly and the second set of TECs in the second TEC assembly.

10. The TEC system of claim 9, further comprising a first cold-side heat exchanger disposed on a planar surface of at least one TEC of the first TEC assembly opposite from the single heat exchanger and a second cold-side heat exchanger disposed on a planar surface of at least one TEC of the second TEC assembly opposite from the single heat exchanger.

11. The TEC system of claim 9, wherein one or more fluid conduits extend through at least a portion of the single heat exchanger.

12. The TEC system of claim 11, wherein the one or more fluid conduits communicate fluid across one or more TECs of the first TEC assembly one or more TECs of the second TEC assembly.

13. The TEC system of claim 9, wherein the single heat exchanger comprises fins.

14. The TEC system of claim 9, wherein the single heat exchanger comprises at least one of aluminum or copper.

15. The TEC system of claim 9, wherein the single heat exchanger transfers heat from a cooling side of at least one TEC of the first TEC assembly to a heating side of at least one TEC of the second TEC assembly.

16. The EC system of claim 9, wherein the single heat exchanger provides direct thermal communication with one or more TECs of the first TEC assembly and the second TEC assembly.

17. The TEC system of claim 9, wherein the TEC system is disposed in a housing of a thermoelectric-based air conditioning system to provide two or more temperature independent air flow streams.

18. A thermoelectric cooler (TEC) system comprising: a first TEC assembly configured to independently condition air within a first supply air channel, the first TEC assembly comprising: a first supply outlet forming at least a portion of the first supply air channel, and a first set of TECs and a first supply side heat exchanger operably connected to a supply side of the first set of TECs; a second TEC assembly configured to independently condition air with a second supply air channel, the second TEC assembly comprising a second supply outlet forming at least a portion of the second supply air channel, and a second set of TECs and a second supply side heat exchanger operably connected to a supply side of the second set of TECs; and a single heat exchanger configured to transfer heat with exhaust sides of both the first set of TECs in the first TEC assembly and the second set of TECs in the second TEC assembly, wherein one or more fluid conduits extend through at least a portion of the single heat exchanger.

19. The TEC system of claim 18, further comprising a first cold-side heat exchanger disposed on a planar surface of at least one TEC of the first TEC assembly opposite from the single heat exchanger and a second cold-side heat exchanger disposed on a planar surface of at least one TEC of the second TEC assembly opposite from the single heat exchanger.

20. The TEC system of claim 18, wherein the single heat exchanger transfers heat from a cooling side of at least one TEC of the first TEC assembly to a heating side of at least one TEC of the second TEC assembly.

* * * * *